US008466213B2

(12) United States Patent
Ueno et al.

(10) Patent No.: US 8,466,213 B2
(45) Date of Patent: Jun. 18, 2013

(54) WHITE INK COMPOSITION FOR INK JET TEXTILE PRINTING AND INK JET TEXTILE PRINTING PROCESS

(75) Inventors: Yoshiaki Ueno, Osaka (JP); Yoichi Sato, Osaka (JP); Akinori Moriyama, Osaka (JP); Masakazu Ohashi, Osaka (JP)

(73) Assignee: Sakata Inx Corp., Osaka (JP)

( * ) Notice: Subject to any disclaimer, the term of this patent is extended or adjusted under 35 U.S.C. 154(b) by 967 days.

(21) Appl. No.: 12/108,544

(22) Filed: Apr. 24, 2008

(65) Prior Publication Data

US 2008/0268156 A1 Oct. 30, 2008

(30) Foreign Application Priority Data

Apr. 24, 2007 (JP) ..... 2007-114628

(51) Int. Cl.
*C09D 11/00* (2006.01)

(52) U.S. Cl.
USPC ..... 523/160; 523/161; 427/288; 524/413

(58) Field of Classification Search
USPC ..... 523/160, 161
See application file for complete search history.

(56) References Cited

U.S. PATENT DOCUMENTS 5,925,693 A * 7/1999 Sanborn ..... 523/161
5,939,468 A * 8/1999 Siddiqui ..... 523/161
6,160,059 A * 12/2000 Roth et al. ..... 526/64
2006/0173096 A1* 8/2006 Ota ..... 523/161
2007/0060670 A1* 3/2007 Ellis ..... 523/160

FOREIGN PATENT DOCUMENTS

JP 08-288636 11/1996
JP 2005-161583 6/2005

* cited by examiner

*Primary Examiner* — Doris Lee
(74) *Attorney, Agent, or Firm* — Antonelli, Terry, Stout & Kraus, LLP.

(57) ABSTRACT

The object of the invention is to provide a white ink composition for ink jet textile printing by which even if printing is carried out without discoloring the dye of textile piece, the whiteness degree of a dyed article obtained is high and the dyed article superior in coating film durability and laundering fastness is further obtained without losing the drape of the textile piece. The invention is directed to a white ink composition for ink jet textile printing including a white pigment, a polymer dispersant, an anionic resin emulsion and an aqueous medium, wherein the polymer dispersant is a polymer dispersant (A) obtained by neutralizing a anionic water-soluble resin having a glass transition temperature of 0 to 80° C., an acid value of 100 to 300 mgKOH/g and a mass average molecular weight of 5000 to 30000 with a basic compound, and the anionic resin emulsion is an anionic resin emulsion (B) with a glass transition temperature of at most 0° C, and the mass ratio of the content of the polymer dispersant (A) and that of the anionic resin emulsion (B) is (A)/(B)=1/5 to 1/10 converted to each solid content.

7 Claims, No Drawings

WHITE INK COMPOSITION FOR INK JET TEXTILE PRINTING AND INK JET TEXTILE PRINTING PROCESS

BACKGROUND OF THE INVENTION

The present invention relates to a white ink composition for ink jet textile printing by which even if printing is carried out without discoloring the dye of textile piece, the whiteness degree of a dyed article obtained is high and the dyed article superior in coating film durability and laundering fastness is further obtained without losing the drape of the textile piece, and an ink jet textile printing process using the white ink composition for ink jet textile printing.

Handwriting and a screen printing system have been conventionally main in a printing process, but the utilization of an ink jet recording process capable of extremely simple and continuous dying for long textile piece has been recently carried out often.

Further, as the ink utilized, aqueous ink using a pigment as a coloring agent has been marked in place of a dye that is brilliant and broad in reproducible color area but to the contrary, low in light stability and troublesome in post steps such as fixation, rinsing with water and waste liquid treatment.

Concerning printing on textile piece with deep color, a process is mainly carried out, in which the dye of a printing portion is preliminarily removed by using a discharging agent and then aqueous ink using the above-mentioned pigment is printed.

The process has a problem that the color of the textile piece from which the dye of the textile piece was removed is assumed as white but since the whiteness degree is imperfect, the sharpness of an image in inferior when printing is carried out on the portion.

As a process for solving the problem, there has been recently carried out a process of directly printing on textile piece with dark color using white ink jet ink and further printing with colored ink jet ink.

As the white ink jet ink printed on the textile piece, there are proposed, for example, processes such as a process of printing a white ink composition for ink jet textile printing including hollow polymer particles as a white pigment (for example, refer to Japanese Unexamined Patent Publication No. 161583/2005) and a process of printing a white ink composition for ink jet textile printing including a pigment, an anionic aqueous resin and two kinds of a low melt flow resin emulsion with a melt flow temperature of 60 to 100° C. and a high glass transition temperature resin emulsion with a glass transition temperature of 140 to 200° C. (for example, refer to Japanese Unexamined Patent Publication No. 288636/1996).

However, there are problems that when the hollow polymer particles are used as the white pigment, adequate whiteness degree cannot be obtained and when an ink composition including a resin emulsion with a glass transition temperature of at least 140° C. is printed, the drape of the textile piece is damaged.

SUMMARY OF THE INVENTION

It is an object of the present invention to provide a white ink composition for ink jet textile printing by which even if printing is carried out without discoloring the dye of textile piece, the whiteness degree of a dyed article obtained is high and the dyed article superior in coating film durability and laundering fastness is further obtained without losing the drape of the textile piece, and an ink jet textile printing process using the white ink composition for ink jet textile printing.

The present inventors have intensively studied for solving the above-mentioned problems and as a result, they have found that the above-mentioned problems can be solved by using those including an anionic water-soluble resin obtained by neutralizing a specific anionic water-soluble resin as a polymer dispersant with a basic compound and an anionic resin emulsion with a glass transition temperature of at most 0° C., at a specific ratio, as a white ink composition for ink jet textile printing, to complete the present invention.

Namely, the present invention relates to (1) a white ink composition for ink jet textile printing including a white pigment, a polymer dispersant, an anionic resin emulsion and an aqueous medium, wherein the polymer dispersant is a polymer dispersant (A) obtained by neutralizing a anionic water-soluble resin having a glass transition temperature of 0 to 80° C., an acid value of 100 to 300 mg KOH/g and a mass average molecular weight of 5,000 to 30,000 with a basic compound, and the anionic resin emulsion is an anionic resin emulsion with a glass transition temperature of at most 0° C., and the mass ratio of the content of the polymer dispersant (A) and that of the anionic resin emulsion (B) is (A)/(B)=1/5 to 1/10 converted to each solid content.

Further, the present invention relates to (2) the white ink composition for ink jet textile printing of the above-mentioned claim (1), wherein an anionic water-soluble resin with a glass transition temperature of 0 to 60° C., an acid value of 130 to 240 mg KOH/g and a mass average molecular weight of 8,000 to 20,000 is used as the above-mentioned polymer dispersant.

Further, the present invention relates to (4) the white ink composition for ink jet textile printing of the above-mentioned claim (2), wherein the above-mentioned anionic resin emulsion is an anionic resin emulsion having self-crosslinking property.

Further, the present invention relates to (5) the white ink composition for ink jet textile printing of above-mentioned claims (1) to, wherein as the above-mentioned white pigment, titanium dioxide that is at least one kind selected from the group of titanium dioxide having a surface treated by coating with alumina and titanium dioxide having a surface treated by coating with alumina and silica (provided that the mass ratio of alumina to silica used in the coating treatment is alumina/silica ≧0.5) and further in which the average primary particle diameter is 0.21 to 0.28 μm and oil absorption amount is 15 to 33 ml/100 g is used.

Further, the present invention relates to (6) the white ink composition for ink jet textile printing of above-mentioned claims (2) to, wherein as the above-mentioned white pigment, titanium dioxide that is at least one kind selected from the group of titanium dioxide having a surface treated by coating with alumina and titanium dioxide having a surface treated by coating with alumina and silica (provided that the mass ratio of alumina to silica used in the coating treatment is alumina/silica ≧0.5) and further in which the average primary particle diameter is 0.21 to 0.28 μm and oil absorption amount is 15 to 33 ml/100 g is used.

Further, the present invention relates to (7) an ink jet textile printing process including the steps of treating a textile piece with a treatment solution including at least water-soluble polyvalent a metal salt and an aqueous medium and then printing the white ink composition for ink jet textile printing of any one of the above-mentioned claims (1) to form an image.

Herein, the glass transition temperature, acid value and mass average molecular weight can be determined by the methods below.

<Glass Transition Temperature>

The glass transition temperature is theoretical glass transition temperature determined by the Wood formula described below.

$$1/Tg = W/Tg1 + W2/Tg2 + W3/Tg3 + \ldots + Wx/Tgx \quad \text{Wood formula}$$

(Wherein Tg1 to Tgx represent the glass transition temperature of respective homopolymers of monomers 1, 2, 3—constituting a copolymer, W1 to Wx represent the polymerization fraction of respective monomers 1, 2, 3—x and Tg represents theoretical glass transition temperature. Provided that the glass transition temperature in the Wood formula is absolute temperature.)

<Acid Value>The acid value is a theoretical value determined from the composition of the copolymer by calculation.

<Mass Average Molecular Weight>

The mass average molecular weight can be measured by a Gel Permeation Chromatography (GPC) method. As an example, chromatography is carried out by using Water 2690 (manufactured by Waters Co.) as a GPC device and PL gel 5μ MIXED-D (Polymer Laboratories Co.) as a column and it can be determined as mass average molecular weight converted to polystyrene.

The white ink composition for ink jet textile printing of the present invention is a white ink composition for ink jet textile printing in which even if printing is carried out without discoloring the dye of textile piece, the whiteness degree of a dyed article obtained is high and the dyed article superior in coating film durability and laundering fastness is further provided without losing the drape of the textile piece.

DETAILED DESCRIPTION

The white ink composition for ink jet textile printing and the ink jet textile printing process of the present invention are described below.

First, the white ink composition for ink jet textile printing of the present invention is described.

The white ink composition for ink jet textile printing (hereinafter, also occasionally described merely as the ink composition) includes a white pigment being a coloring component, a polymer dispersant, an anionic resin emulsion being a binding component and an aqueous medium.

As the white pigment, those having high shielding property such as titanium dioxide and zinc oxide are preferably used. Among these, titanium dioxide is preferable from the viewpoint of obtaining high light blocking effect. The titanium dioxide is various titanium dioxides such as rutile type and anatase type that have been conventionally used and more preferably those having a surface treated by coating with alumina and those treated by coating with alumina and silica. Further, those treated by coating with alumina and silica are further preferably those in which the mass ratio of alumina to silica used in coating treatment is alumina/silica ≧0.5. Further, those in which an average primary particle diameter is 0.21 to 0.28 μm and oil absorption amount is 15 to 33 ml/100 g are preferable in particular in the titanium dioxide having a surface treated by coating. Herein, the oil absorption amount is the oil absorption amount prescribed in JIS K5101.

The content of the above-mentioned white pigment is preferably a range of 10 to 30% by mass in the ink composition.

Then, as the polymer dispersant, there can be used a polymer dispersant (A) obtained by neutralizing a anionic water-soluble resin with a glass transition temperature of 0 to 80° C., an acid value of 100 to 300 mg KOH/g and a mass average molecular weight of 5000 to 30000 with a basic compound.

The example of the anionic water-soluble resin used as the polymer dispersant (A) is a copolymer obtained by selecting 1 or at least 2 of carboxyl group-containing unsaturated monomers (including anhydride group-containing unsaturated monomers which give a carboxyl group by ring-opening) such as acrylic acid, methacrylic acid, itaconic acid, maleic acid, maleic anhydride, monoalkyl maleate, citraconic acid, citraconic anhydride and monoalkyl citraconate, styrene monomers such as styrene, α-methylstyrene and vinyl toluene, and 1 or at least 2 of unsaturated monomers selected from aralkyl methacrylates or acrylates such as benzyl methacrylate and benzyl acrylate and alkyl methacrylates or acrylates such as methyl methacrylate, butyl methacrylate, 2-ethylhexyl methacrylate, stearyl methacrylate, lauryl methacrylate, methyl acrylate, buthyl acrylate, 2-ethylhexyl acrylate, stearyl acrylate and lauryl acrylate so that the glass transition temperature is 0 to 80° C. and the acid value is 100 to 300 mg KOH/g and by reacting them so that the mass average molecular weight is 5,000 to 30,000; and a copolymer obtained by selecting them so that a monomer component having an aromatic ring such as a styrene monomer is 0 to 50% by mass based on the whole monomer components and by reacting them so that the glass transition temperature is 0 to 60° C., the acid value is 130 to 240 mg KOH/g and the mass average molecular weight is 8,000 to 20,000 can be more preferably utilized.

Further, when the acid value of the anionic aqueous resin is less than 100 mg KOH/g, the solubility of the resin in aqueous medium is lowered and when it exceeds 300 mg KOH/g, the water resistance of a printed article printing on a textile piece obtained is lowered.

Further, when the glass transition temperature of the anionic water-soluble resin is less than 0° C., the fusion of mutual pigment dispersion particles is easily generated and storage stability and discharge stability are lowered and when it exceeds 80° C., the drape of the printed article obtained is lowered.

Further, when the mass average molecular weight of the anionic water-soluble resin is less than 5,000, the stability of pigment dispersion is lowered and on the other hand, when it exceeds 30000, pigment dispersibility in an aqueous medium is lowered.

The specific example of the anionic water-soluble resin includes copolymers such as an alkyl (meth)acrylate-(meth) acrylic acid copolymer, a styrene-(meth)acrylic acid copolymer, a styrene-(meth)acrylic acid-alkyl (meth)acrylate copolymer, a styrene-maleic acid-alkyl (meth)acrylate copolymer, a styrene-maleic acid half ester copolymer, a styrene-maleic acid half ester-alkyl (meth)acrylate copolymer and a styrene-(meth)acrylic acid-alkyl (meth)acrylate-benzyl (meth)acrylate copolymer.

The basic compound includes alkali metal hydroxides such as sodium hydroxide and potassium hydroxide and organic basic compounds such as triethylamine, monoethanolamine, triethanolamine and triethylenediamine. These may be used alone and at least 2 may be used in combination.

The amount of the above-mentioned polymer dispersant used is preferably 10 to 40 parts by mass based on 100 parts by mass of the white pigment and more preferably 15 to 30 parts by mass. When the amount of the polymer dispersant used is less than 10 parts by mass, pigment dispersibility in an aqueous medium is lowered and on the other hand, when it exceeds 50 parts by mass, viscosity is heightened; therefore since the compounding amount of the anionic resin emulsion described later and the compounding amount of an aqueous medium described later are limited, laundering fastness and discharge stability are lowered.

Then, as the anionic resin emulsion, the anionic resin emulsion (B) in which the glass transition temperature is lower than 0° C. can be used. When the glass transition temperature is higher than 0° C., the drape of a textile piece is lowered.

Further, the use ratio of the anionic resin emulsion (B) to the polymer dispersant (A) is preferably (A)/(B)=1/5 to 1/10 converted to a solid content. When the use ratio of the anionic resin emulsion (B) to the polymer dispersant (A) is the latter of at most 5 for the former of 1, adequate laundering fastness is not obtained and on the other hand, when the latter exceeds 10 for the former of 1, the viscosity of the ink composition is heightened; therefore adequate pigment concentration cannot be obtained, or coagulation and precipitation for a treatment solution described later are inadequate and high image density is not obtained.

The anionic resin emulsion includes an acryl resin, a styrene-acryl resin, a urethane resin, a polyester resin, an olefin resin and vinyl acetate resin. Further, when higher water resistance and higher laundering fastness are required, it is preferable that a cross-linking component thermally cross-linked by itself is introduced to the anionic resin emulsion within a range not lowering drape. These may be used alone and at least 2 may be used in combination.

Then, the aqueous medium is not specifically limited and water, or a mixture of water with water-miscible solvent that has generally used in ink jet field conventionally can be used. The specific example of the above-mentioned water-miscible solvent includes lower alcohols such as ethanol and propanol, polyvalent alcohols such as glycerin, (poly)alkylene glycol such as (poly)ethylene glycol and (poly)propylene glycol and alkyl ethers thereof, and these may be used alone and at least 2 may be used in combination.

In the white ink composition for ink jet textile printing of the present invention, the total solid content of summing the white pigment, polymer dispersant and anionic resin emulsion is preferably a range of 25 to 45% by mass in the ink composition. When the content of the total solid content of summing the white pigment, polymer dispersant and anionic resin emulsion is less than 25% by mass, the printing density of a printed article printing on a textile piece is lowered and on the other hand, when it exceeds 45% by mass, viscosity tends to be high and discharge stability is lowered.

Further, in the white ink composition for ink jet textile printing of the present invention, various additives such as a surfactant, a viscosity conditioning agent, a defoaming agent and a film forming aid can be added in the ink composition if necessary.

Further, viscosity in the ink composition obtained is preferably a range of 2 to 20 mPa·s. Further, the surface tension of the ink composition is preferably a range of 25 to 45 mN/m.

The production of the ink composition of the present invention using materials above can be carried out by general methods. For example, there is mentioned a method of obtaining an ink composition by mixing the white pigment, polymer dispersant, anionic resin emulsion, aqueous medium, if necessary, a surfactant, a viscosity conditioning agent and a defoaming agent, dispersing them using various dispersing and stirring machines such as, for example, a beads mill, a ball mill, a sand mill, an Atrighter, a roll mill, an agitator, a Henschel mixer, a colloid mixer, an ultrasonic homogenizer, an ultra high pressure homogenizer and a pearl mill, and further adding and mixing residual materials such as the anionic resin emulsion.

Then, the ink jet textile printing process of printing the white ink composition for ink jet textile printing of the present invention on a textile piece to form an image is described. Further, since it is preferable that the ink composition is printed after the textile piece is preliminarily treated with a treatment solution containing a water-soluble polyvalent metal salt in order to obtain the fixation property and durability of the ink composition to textile piece, the ink jet textile printing process according to the present invention including the treatment is described.

<Compositional Materials Used for the Ink Jet Textile Printing Process of the Invention>

Firstly, the textile piece to which the ink jet textile printing process of the present invention can be applied includes, for example, a single textile piece of cotton, silk, hemp, rayon, acetate, nylon or polyester fiber, or a textile piece including at least 2 of these fibers that have been conventionally used.

Then, as the treatment solution of the textile piece, a treatment solution containing a water-soluble polyvalent metal salt and an aqueous medium that have been conventionally used in the ink jet textile printing process can be used.

The example of the water-soluble polyvalent metal salt includes the dissociative salt of alkali earth metals such as Ca and Mg and the typical example of the compound includes $CaCl_2$, $Ca(OH)_2$, $(CH_3COO)_2Ca$, $MgCl_2$, $Mg(OH)_2$ and $(CH_3COO)_2Mg$. Among these, the salts of Ca are preferable.

The content of the water-soluble polyvalent metal salt in the treatment solution is not specifically limited and, for example, is about 0.1 to about 40% by mass of the water-soluble polyvalent metal salt in the treatment solution.

As the aqueous medium, those described in the white ink composition for ink jet textile printing can be used.

Further, the treatment solution can contain a water-soluble polymer for imparting viscosity if necessary. The specific example of the water-soluble polymer includes known natural water-soluble polymers such as natural polymers such as starch substances such as sweet corn and wheat; cellulose substances such as carboxymethyl cellulose, methyl cellulose and hydroxyethyl cellulose; polysaccharides such as sodium arginate, gum Arabic, Locust bean gum, gum tragacanth, gum guar and temarind seeds; protein substances such as gelatin and casein; tannin substances; and lignin substances. Further, the example of the synthetic polymer includes known polyvinyl alcohol compounds, a polyethylene oxide compound, an acrylic acid water-soluble polymer and a maleic anhydride water-soluble polymer. Among these, polysaccharides polymer and cellulose polymer are preferable.

The materials above are mixed by stirring to obtain the treatment solution and treatment can be carried out by immersing a textile piece in this and coating the solution on a textile piece by various coating means and spray means.

Then, the white ink composition for ink jet textile printing described in the description is used as a white ink composition for ink jet textile printing.

<Ink Jet Textile Printing Process of the Invention>

Then, the ink jet textile printing process of the present invention is described based on its preferable Embodiments.

The ink jet textile printing process of the present invention includes (1) a method of forming an image by treating a textile piece with the above-mentioned treatment solution to dry it, forming a white image by carrying out printing corresponding to recording signal with a head for ink jet recording using the white ink composition for ink jet textile printing of the invention, and carrying out printing corresponding to the recording signal on the white image using the white ink composition for ink jet textile printing other than white color, and (2) a method of forming an image by treating a textile piece with the above-mentioned treatment solution to dry it and carrying out printing corresponding to the recording signal with a head for ink jet recording using the white ink composition for ink jet textile printing of the present invention.

Further, as the above-mentioned ink jet printer, known ink jet printers can be used. For example, there is mentioned a device that imparts thermal energy corresponding to the recording signal to the ink in the chamber of the head for ink jet recording and generates liquid drops by the thermal energy.

Then, the textile piece, in which the image of the present invention has been formed is heated, for example, at a temperature of about 100 to 180° C. and the image is fixed on the textile piece. The heating to the textile piece can be carried out using known heating means such as a pressing iron, a drier and a drying machine.

EXAMPLE

The invention is further specifically described according to Examples but the present invention is not limited to only these Examples.

[Property Value of Titanium Dioxide]

<Average Primary Particle Diameter>

It was measured with an image analysis device based on the photograph of a transmission electron microscope.

<Oil Absorption Amount>

It was measured based on JIS K5101.

[Preparation of Treatment Solution]

5 Parts by mass of calcium chloride and 5 by mass of polyethylene glycol with a weight average molecular weight of 1000 were added to 90 by mass of water and the mixture was stirred to obtain a treatment solution.

[Preparation of Polymer Dispersant Solution]

<Preparation of Polymer Dispersant Solution 1>

25 Parts by mass of a solid acrylic acid/n-butyl acrylate/benzyl methacrylate/styrene copolymer with a glass transition temperature of 40° C., a mass average molecular weight of 10,000 and an acid value of 150 mg KOH/g was dissolved in a mix solution of 3.2 parts by mass of sodium hydroxide and 71.8 parts by mass of water to obtain a polymer dispersant solution 1 with a resin solid content of 25% by mass.

<Preparation of Polymer Dispersant Solution 2>

25 Parts by mass of a solid acrylic acid/n-butyl acrylate/benzyl methacrylate/styrene copolymer with a glass transition temperature of 20° C., a mass average molecular weight of 10,000 and an acid value of 150 mg KOH/g was dissolved in a mix solution of 3.2 parts by mass of sodium hydroxide and 71.8 parts by mass of water to obtain a polymer dispersant solution 2 with a resin solid content of 25% by mass.

<Preparation of Polymer Dispersant Solution 3>

25 Parts by mass of a solid acrylic acid/n-butyl acrylate/benzyl methacrylate/styrene copolymer with a glass transition temperature of 60° C., a mass average molecular weight of 10,000 and an acid value of 150 mg KOH/g was dissolved in a mix solution of 3.2 parts by mass of sodium hydroxide and 71.8 parts by mass of water to obtain a polymer dispersant solution 3 with a resin solid content of 25% by mass.

<Preparation of Polymer Dispersant Solution 4>

25 Parts by mass of a solid acrylic acid/methyl methacrylate/ styrene copolymer with a glass transition temperature of 100° C., a mass average molecular weight of 10,000 and an acid value of 150 mg KOH/g was dissolved in a mix solution of 3.2 parts by mass of sodium hydroxide and 71.8 parts by mass of water to obtain a polymer dispersant solution 4 with a resin solid content of 25% by mass.

<Preparation of Polymer Dispersant Solution 5>

25 Parts by mass of a solid acrylic acid/n-butyl acrylate/benzyl methacrylate copolymer with a glass transition temperature of −40° C., a mass average molecular weight of 10,000 and an acid value of 150 mg KOH/g was dissolved in a mix solution of 3.2 parts by mass of sodium hydroxide and 71.8 parts by mass of water to obtain a polymer dispersant solution 5 with a resin solid content of 25% by mass.

[Preparation of Aqueous White Ink Base for Ink Jet Textile Printing]

<Preparation of Aqueous White Ink Base for Ink Jet Textile Printing 1>

19 Parts by mass of water was added to 36 parts by mass of the polymer dispersant solution 1 and mixed to prepare resin varnish for dispersing titanium dioxide, further, 45 parts by mass of titanium dioxide (CR-90, treated with alumina and silica (alumina/silica ≧0.5) and an average primary particle diameter of 0.25 μm and an oil absorption amount of 21 ml/100 g; available from Ishihara Sangyo Kaisha Ltd.) was added to be mixed by stirring, and then, kneading was carried out with a wet circulation mill to obtain an aqueous white ink base for ink jet textile printing 1 (titanium dioxide/dispersant=1/0.2 mass ratio).

<Preparation of Aqueous White Ink Base for Ink Jet Textile Printing 2>

19 Parts by mass of water was added to 36 parts by mass of the polymer dispersant solution 2 and mixed to prepare resin varnish for dispersing titanium dioxide, further, 45 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 2 (titanium dioxide/dispersant=1/0.2 mass ratio).

<Preparation of Aqueous White Ink Base for Ink Jet Textile Printing 3>

19 Parts by mass of water was added to 36 parts by mass of the polymer dispersant solution 3 and mixed to prepare resin varnish for dispersing titanium dioxide, further, 45 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 3 (titanium dioxide/dispersant=1/0.2 mass ratio).

<Preparation of Aqueous White Ink Base for Ink Jet Textile Printing 4>

19 Parts by mass of water was added to 36 parts by mass of the polymer dispersant solution 4 and mixed to prepare resin varnish for dispersing titanium dioxide, further, 45 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 4 (titanium dioxide/dispersant=1/0.2 mass ratio).

<Preparation of Aqueous White Ink Base for Ink Jet Textile Printing 5>

19 Parts by mass of water was added to 36 parts by mass of the polymer dispersant solution 5 and mixed to prepare resin varnish for dispersing titanium dioxide, further, 45 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 5 (titanium dioxide/dispersant=1/0.2 mass ratio).

<Preparation of Aqueous White Ink Base for Ink Jet Textile Printing 6>

28 Parts by mass of water was added to 27 parts by mass of the polymer dispersant solution 1 and mixed to prepare resin varnish for dispersing titanium dioxide, further, 45 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 6 (titanium dioxide/dispersant=1/0.15 mass ratio).

<Preparation of Aqueous White Ink Base for Ink Jet Textile Printing 7>

12 Parts by mass of water was added to 48 parts by mass of the polymer dispersant solution 1 and mixed to prepare resin varnish for dispersing titanium dioxide, further, 40 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 7 (titanium dioxide/dispersant=1/0.3 mass ratio).

<Preparation of Aqueous White Ink Base for Ink Jet Textile Printing 8>

2 Parts by mass of water was added to 63 parts by mass of the polymer dispersant solution 1 and mixed to prepare resin varnish for dispersing titanium dioxide, further, 35 parts by mass of titanium dioxide (CR-90, available from Ishihara Sangyo Kaisha Ltd.) was added to be mixed by stirring, and then, kneading was carried out with a wet circulation mill to obtain an aqueous white ink base for ink jet textile printing 8 (titanium dioxide/dispersant=1/0.45 mass ratio).

[Preparation of Aqueous White Ink for Ink Jet Textile Printing]

<Aqueous White Ink for Ink Jet Textile Printing>

The compositions of the aqueous white ink for ink jet textile printing obtained in Examples 1 to 7 and Comparative Examples 1 to 6 described below are shown in Table 1. Provided that the amounts of the resin emulsion showed solid content amounts. Further, the water amounts in the ink bases and the resin emulsions were shown together with the amount of water newly used at the preparation of the aqueous white ink for ink jet textile printing.

Example 1

40 Parts by mass of an anionic acryl resin emulsion (commodity name: Mowinyl 952, manufactured by Nichigo-Mowinyl Co., Ltd., a solid content of 45% by mass) with a glass transition temperature of −38° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 1 to obtain the aqueous white ink for ink jet textile printing 1 of Example 1.

Example 2

43.3 Parts by mass of an anionic acryl resin emulsion (commodity name: Mowinyl 952, manufactured by Nichigo-Mowinyl Co., Ltd., a solid content of 45% by mass) with a glass transition temperature of −38° C., 17 parts by mass of glycerin, 1 part by mass of ACETYLENOL E100 (the ethylene oxide adduct of acetylene glycol, available from Kawaken Fine Chemical Co., Ltd.) and 9.8 parts by mass of water were mixed by stirring to 28.9 parts by mass of the aqueous white ink base for ink jet textile printing 6 to obtain the aqueous white ink for ink jet textile printing 2 of Example 2.

Example 3

40 Parts by mass of an anionic acryl resin emulsion (commodity name: Mowinyl 718A, manufactured by Nichigo-Mowinyl Co., Ltd., a solid content of 45% by mass) with a glass transition temperature of −6° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 1 to obtain the aqueous white ink for ink jet textile printing 3 of Example 3.

Example 4

40 Parts by mass of an anionic acryl resin emulsion (commodity name: Mowinyl 952, manufactured by Nichigo-Mowinyl Co., Ltd., a solid content of 45% by mass) with a glass transition temperature of −38° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 2 to obtain the aqueous white ink for ink jet textile printing 4 of Example 4.

Example 5

40 Parts by mass of an anionic acryl resin emulsion (commodity name: Mowinyl 952, manufactured by Nichigo-Mowinyl Co., Ltd., a solid content of 45% by mass) with a glass transition temperature of −38° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 3 to obtain the aqueous white ink for ink jet textile printing 5 of Example 5.

Example 6

30 Parts by mass of an anionic acryl resin emulsion (commodity name: Mowinyl 952, manufactured by Nichigo-Mowinyl Co., Ltd., a solid content of 45% by mass) with a glass transition temperature of −38° C., 20 parts by mass of glycerin, 1 part by mass of ACETYLENOL E100 (the ethylene oxide adduct of acetylene glycol, available from Kawaken Fine Chemical Co., Ltd.) and 15.7 parts by mass of water were mixed by stirring to 33.3 parts by mass of the aqueous white ink base for ink jet textile printing 6 to obtain the aqueous white ink for ink jet textile printing 6 of Example 6.

Example 7

48 Parts by mass of an anionic acryl resin emulsion (commodity name: Mowinyl 952, manufactured by Nichigo-Mowinyl Co., Ltd., a solid content of 45% by mass) with a glass transition temperature of −38° C., 15 parts by mass of glycerin, 1 part by mass of ACETYLENOL E100 (the ethylene oxide adduct of acetylene glycol, available from Kawaken Fine Chemical Co., Ltd.) and 3.5 parts by mass of water were mixed by stirring to 32.5 parts by mass of the aqueous white ink base for ink jet textile printing 7 to obtain the aqueous white ink for ink jet textile printing 7 of Example 7.

Comparative Example 1

40 Parts by mass of an anionic acryl resin emulsion (commodity name: Mowinyl 952, manufactured by Nichigo- Mowinyl Co., Ltd., a solid content of 45% by mass) with a glass transition temperature of −38° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 4 to obtain the aqueous white ink for ink jet textile printing 8 of Comparative Example 1.

Comparative Example 2

40 Parts by mass of an anionic acryl resin emulsion (commodity name: Mowinyl 952, manufactured by Nichigo-Mowinyl Co., Ltd., a solid content of 45% by mass) with a glass transition temperature of −38° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 5 to obtain the aqueous white ink for ink jet textile printing 9 of Comparative Example 2.

Comparative Example 3

40 Parts by mass of an anionic acryl resin emulsion (commodity name: Mowinyl 710A, manufactured by Nichigo-Mowinyl Co., Ltd., a solid content of 45% by mass) with a glass transition temperature of 9° C., 15 parts by mass of glycerin, 1 part by mass of ACETYLENOL E100 (the ethylene oxide adduct of acetylene glycol, available from Kawaken Fine Chemical Co., Ltd.) and 10.7 parts by mass of water were mixed by stirring to 33.3 parts by mass of the aqueous white ink base for ink jet textile printing 1 to obtain the aqueous white ink for ink jet textile printing 10 of Comparative Example 3.

Comparative Example 4

45 Parts by mass of an anionic acryl resin emulsion (commodity name: Mowinyl 952A, manufactured by Nichigo-Mowinyl Co., Ltd., a solid content of 45% by mass) with a glass transition temperature of −38° C., 11 parts by mass of glycerin and 1 part by mass of ACETYLENOL E100 (the ethylene oxide adduct of acetylene glycol, available from Kawaken Fine Chemical Co., Ltd.) were mixed by stirring to 43 parts by mass of the aqueous white ink base for ink jet textile printing 8 to obtain the aqueous white ink for ink jet textile printing 11 of Comparative Example 4.

Comparative Example 5

13.3 Parts by mass of an anionic acryl resin emulsion (commodity name: Mowinyl 952A, manufactured by Nichigo-Mowinyl Co., Ltd., a solid content of 45% by mass) with a glass transition temperature of −38° C., 25 parts by mass of glycerin, 1 part by mass of ACETYLENOL E100 (the ethylene oxide adduct of acetylene glycol, available from Kawaken Fine Chemical Co., Ltd.) and 27.4 parts by mass of water were mixed by stirring to 33.3 parts by mass of the aqueous white ink base for ink jet textile printing 1 to obtain the aqueous white ink for ink jet textile printing 12 of Comparative Example 5.

Comparative Example 6

56 Parts by mass of an anionic acryl resin emulsion (commodity name: MOBINEELE 952A, manufactured by NICHIGO MOBINEELE Co., a solid content of 45% by mass) with a glass transition temperature of −38° C., 11 parts by mass of glycerin, 1 part by mass of ACETYLENOL E100 (the ethylene oxide adduct of acetylene glycol, available from Kawaken Fine Chemical Co., Ltd.) and 0.9 part by mass of water were mixed by stirring to 33.1 parts by mass of the aqueous white ink base for ink jet textile printing 1 to obtain the aqueous white ink for ink jet textile printing 13 of Comparative Example 6.

<Evaluation Method>

(Viscosity)

The viscosities of respective aqueous white inks for ink jet textile printing of Examples 1 to 7 and Comparative Examples 1 to 6 were measured at 25° C. using an R115 type viscometer (RE107) manufactured by TOKI SANGYO CO., LTD.

<Surface Tension>

The surface tensions of respective aqueous white inks for ink jet textile printing of Examples 1 to 7 and Comparative Examples 1 to 6 were measured at 25° C. using an automatic wetting tester (WET-6000) manufactured by RESCA CO., LTD.

(Print)

The respective aqueous white inks for ink jet textile printing of Examples 1 to 7 and Comparative Examples 1 to 6 were printed in mode in which one color printing was duplicated four times, on textile pieces that were prepared by immersing the above-mentioned treatment solution on black textile pieces with cotton of 100% to be dried, using a printer for evaluation mounting a head manufactured by SPECTRA Inc., then, the printed portion was heated at a temperature of 180° C. for 30 seconds using a heat press machine, and the respective aqueous white inks for ink jet textile printing were fixed on the textile pieces to obtain the printed articles of Examples 1 to 7 and Comparative Examples 1 to 6.

(Image Density)

The brightness of each of printed articles of Examples 1 to 7 and Comparative Examples 1 to 6 was measured using a colorimeter (Commodity number: DR-321 manufactured by Konica Minolta Engineering Inc.).

Evaluation Result

◎: L* is at least 80.

○: L* is at least 70 and less than 80.

Δ: L* is at least 50 and less than 70.

X: L* is less than 50.

(Coating Film Resistance)

Each of the printed articles of Examples 1 to 7 and Comparative Examples 1 to 6 was elongated by stretching 5 times (elongated by stretching to limit by every time) and the crack and peeling of the coating film was visually evaluated.

Evaluation Result

◎: No crack and no peeling of the coating film were observed.

○: The peeling of the coating film was not observed but crack was slightly generated.

Δ: The peeling of the coating film was not observed but crack was generated.

X: The crack and peeling of the coating film was observed.

(Laundering Fastness)

Each of the printed articles of Examples 1 to 7 and Comparative Examples 1 to 6 was washed 5 times with a laundry machine for home in the mode of usual cleaning (washing condition: cleaning, dehydration and drying at usual mode), the brightness of each of the printed articles before cleaning and after cleaning was measured using a colorimeter (Commodity number: DR-321 manufactured by Konica Minolta Engineering Inc.) and variation rate from the initial value of the brightness (L*) before cleaning was measured and evaluated.

Evaluation Result

◎: Those in which image density keeps at least 90% of the initial value after cleaning.

○: Those in which image density is at least 80% and less than 90% of the initial value after cleaning.

Δ: Those in which image density is at least 70% and less than 80% of the initial value after cleaning.

X: Those in which image density is less than 70% of the initial value after cleaning.

(Drape)

Each of the printed articles of Examples 1 to 7 and Comparative Examples 1 to 6 was evaluated by touching with hands.

Evaluation Result

◎: Those in which the printed article is easily bent and softness is nearly that of the black textile piece with cotton of 100%.

○: Those in which the printed article is easily bent but rough feeling is slightly felt the textile piece itself Δ: Those in which rough feeling is slightly felt for the printed article.

X: Those in which the printed article is hard at a level of not be freely bent.

(Clogging)

Ruled line was printed on textile pieces that were prepared by immersing the above-mentioned treatment solution on black textile pieces with cotton of 100% to be dried, with a printer for evaluation mounting a head manufactured by SPECTRA Inc., using the respective aqueous white inks for ink jet textile printing of Examples 1 to 7 and Comparative Examples 1 to 6, and scattering (bending) and dot missing was visually evaluated.

Evaluation Result

○: Those in which there are no scattering of ink and no dot and clean ruled line can be printed.

Δ: Those in which some scattering is observed but printing can be carried out.

X: Those in which scattering is significant and dot missing occurs.

The above-mentioned evaluation result is shown in Table 1.

TABLE 1

| | Ex. 1 | Ex. 2 | Ex. 3 | Ex. 4 | Ex. 5 | Ex. 6 | Ex. 7 | Com. Ex. 1 | Com. Ex. 2 | Com. Ex. 3 | Com. Ex. 4 | Com. Ex. 5 | Com. Ex. 6 |
|---|---|---|---|---|---|---|---|---|---|---|---|---|---|
| titanium oxide | 15 | 13 | 15 | 15 | 15 | 15 | 13 | 15 | 15 | 15 | 15 | 15 | 14 |
| polymer dispersant solution | | | | | | | | | | | | | |
| 40° C. | 3 | 1.95 | 3 | — | — | 2.25 | 3.9 | — | — | 3 | 6.75 | 3 | 2.1 |
| 20° C. | — | — | — | 3 | — | — | — | — | — | — | — | — | — |
| 60° C. | — | — | — | — | 3 | — | — | — | — | — | — | — | — |
| 100° C. | — | — | — | — | — | — | — | 3 | — | — | — | — | — |
| −40° C. | — | — | — | — | — | — | — | — | 3 | — | — | — | — |
| resin emulsion | | | | | | | | | | | | | |
| −38° C. | 18 | 19.5 | — | 18 | 18 | 13.5 | 21.6 | 18 | 18 | — | 20.25 | 6 | 25.2 |
| −6° C. | — | — | 18 | — | — | — | — | — | — | — | — | — | — |
| 9° C. | — | — | — | — | — | — | — | — | — | 18 | — | — | — |
| glycerin | 15 | 17 | 15 | 15 | 15 | 20 | 15 | 15 | 15 | 15 | 11 | 25 | 11 |
| surfactant | 1 | 1 | 1 | 1 | 1 | 1 | 1 | 1 | 1 | 1 | 1 | 1 | 1 |
| water | 48 | 47.55 | 48 | 48 | 48 | 48.25 | 45.5 | 48 | 48 | 48 | 46 | 50 | 46.7 |
| total | 100 | 100 | 100 | 100 | 100 | 100 | 100 | 100 | 100 | 100 | 100 | 100 | 100 |
| dispersant Tg | 40° C. | 40° C. | 40° C. | 20° C. | 60° C. | 40° C. | 40° C. | 100° C. | −40° C. | 40° C. | 40° C. | 40° C. | 40° C. |
| emulsion Tg | −38° C. | −38° C. | −6° C. | −38° C. | −38° C. | −38° C. | −38° C. | −38° C. | −38° C. | 9° C. | −38° C. | −38° C. | −38° C. |
| titanium dioxide/dispersant | 1/0.2 | 1/0.15 | 1/0.2 | 1/0.2 | 1/0.2 | 1/0.15 | 1/0.3 | 1/0.2 | 1/0.2 | 1/0.2 | 1/0.45 | 1/0.2 | 1/0.15 |
| dispersant/emulsion | 1/6 | 1/10 | 1/6 | 1/6 | 1/6 | 1/6 | 1/6 | 1/6 | 1/6 | 1/6 | 1/3 | 1/2 | 1/12 |
| total solid content (% by mass) | 36 | 34.45 | 36 | 36 | 36 | 30.75 | 38.5 | 36 | 36 | 36 | 42 | 24 | 41.3 |
| viscosity (mPa · s) | 15 | 13 | 15 | 15 | 15 | 15 | 15 | 15 | 15 | 15 | 15 | 15 | 15 |
| surface tension (mN/m) | 32 | 32 | 32 | 32 | 32 | 32 | 32 | 32 | 32 | 32 | 32 | 32 | 32 |
| concentration (L*) | ◎(82) | ○(74) | ◎(81) | ◎(80) | ◎(81) | ○(76) | ○(78) | ○(78) | ◎(80) | ◎(80) | ○(70) | Δ(62) | Δ(60) |
| coating film resistance | ◎ | ◎ | ◎ | ◎ | ◎ | ◎ | ◎ | Δ | Δ | Δ | ○ | Δ | ◎ |
| laundering fastness | ◎ | ◎ | ◎ | ◎ | ◎ | ◎ | ○ | ○ | ○ | Δ | Δ | Δ | ◎ |
| drape | ◎ | ◎ | ○ | ◎ | ○ | ◎ | ○ | Δ | ◎ | Δ | ○ | ◎ | ◎ |
| clogging | ○ | ○ | ○ | ○ | ○ | ○ | ○ | ○ | Δ | Δ | X | ○ | Δ |

What is claimed is:

1. A white ink composition for ink jet textile printing including a white pigment, a polymer dispersant, an anionic acrylic resin emulsion having self-crosslinkinq property, and an aqueous medium, wherein the polymer dispersant is a polymer dispersant (A) obtained by neutralizing a anionic water-soluble resin having a glass transition temperature of 0 to 80° C., an acid value of 100 to 300 mgKOH/g and a mass average molecular weight of 5000 to 30000 with a basic compound, and the anionic acrylic resin emulsion having self-crosslinking property is an anionic acrylic resin emulsion (B) with a glass transition temperature of at most 0° C., and the mass ratio of the content of the polymer dispersant (A) and that of the anionic acrylic resin emulsion (B) is (A)/(B)=1/5 to 1/10 converted to each solid content, and wherein the amount of the polymer dispersant (A) is 10 to 40 parts by mass based on 100 parts by mass of the white pigment.

2. The white ink composition for ink jet textile printing of claim 1, wherein as the white pigment, titanium dioxide that is at least one kind selected from the group of titanium dioxide having a surface treated by coating with alumina and titanium oxide having a surface treated by coating with alumina and silica (provided that the mass ratio of alumina to silica used in the coating treatment is alumina/silica ≧0.5) and further in which an average primary particle diameter is 0.21 to 0.28 μm and oil absorption amount is 15 to 33 ml/100 g is used.

3. The white ink composition for ink jet textile printing of claim 1, wherein a glass transition temperature of the anionic acrylic resin emulsion (B) is at most −6° C.

4. The white ink composition for ink jet textile printing of claim 1, wherein an anionic water-soluble resin with a glass transition temperature of 0 to 60° C., an acid value of 130 to 240 mgKOH/g and a mass average molecular weight of 8000 to 20000 is used as the polymer dispersant.

5. The white ink composition for ink jet textile printing of claim 4, wherein as the white pigment, titanium dioxide that is at least one kind selected from the group of titanium dioxide having a surface treated by coating with alumina and titanium oxide having a surface treated by coating with alumina and silica (provided that the mass ratio of alumina to silica used in the coating treatment is alumina/silica ≧0.5) and further in which an average primary particle diameter is 0.21 to 0.28 μm and oil absorption amount is 15 to 33 ml/100 g is used.

6. An ink jet textile printing process comprising the steps of treating a textile piece with a treatment solution including at least a water-soluble polyvalent metal salt and an aqueous medium and then printing the white ink composition for ink jet textile printing of claim 1 to form an image.

7. An ink jet textile printing process comprising the steps of treating a textile piece with a treatment solution including at least a water-soluble polyvalent metal salt and an aqueous medium and then printing the white ink composition for ink jet textile printing of claim 4 to form an image.

* * * * *